US011219819B1

(12) United States Patent
KuyKendall

(10) Patent No.: US 11,219,819 B1
(45) Date of Patent: Jan. 11, 2022

(54) ELECTRONIC BOARD GAME ASSEMBLY

(71) Applicant: Gregory KuyKendall, Atwater, CA (US)

(72) Inventor: Gregory KuyKendall, Atwater, CA (US)

( * ) Notice: Subject to any disclaimer, the term of this patent is extended or adjusted under 35 U.S.C. 154(b) by 0 days.

(21) Appl. No.: 17/148,677

(22) Filed: Jan. 14, 2021

(51) Int. Cl.
*A63F 9/24* (2006.01)
*A63F 9/06* (2006.01)

(52) U.S. Cl.
CPC ..... *A63F 9/24* (2013.01); *A63F 2009/064* (2013.01); *A63F 2009/241* (2013.01); *A63F 2009/2457* (2013.01); *A63F 2009/2463* (2013.01); *A63F 2009/2483* (2013.01)

(58) Field of Classification Search
USPC ..... 463/37
See application file for complete search history.

(56) References Cited

U.S. PATENT DOCUMENTS 7,927,212 B2 * 4/2011 Hedrick ..... G07F 17/3223 463/29
8,771,084 B2 7/2014 Gawel
10,008,070 B2 1/2018 Nordahl
D810,834 S 2/2018 Kelly
10,055,934 B2 8/2018 Kugler
10,300,375 B2 5/2019 Mulligan
10,672,221 B2 6/2020 Jackson
2003/0054881 A1 * 3/2003 Hedrick ..... G07F 17/3239 463/29
2005/0003890 A1 * 1/2005 Hedrick ..... G07F 17/3202 463/29
2005/0153765 A1 * 7/2005 Shoostine ..... A63F 9/183 463/9
2006/0252529 A1 * 11/2006 Hedrick ..... G07F 17/3234 463/29
2010/0203945 A1 * 8/2010 Pitocchelli ..... A63F 3/0421 463/19
2014/0057691 A1 * 2/2014 Morichau-Beauchant ..... A63F 13/213 463/14
2015/0174476 A1 * 6/2015 Morichau-Beauchant ..... A63F 13/06 463/43
2016/0125686 A1 5/2016 Grubmueller
2019/0201779 A1 * 7/2019 Vargo ..... A41B 1/08
2019/0325708 A1 10/2019 Crawford
2020/0238170 A1 * 7/2020 Alsaid ..... A63F 13/87

FOREIGN PATENT DOCUMENTS

WO WO2014140512 9/2014

* cited by examiner

*Primary Examiner* — Pierre E Elisca

(57) ABSTRACT

An electronic board game assembly for playing digital versions of board games includes a housing that is positionable on a horizontal support to be accessible to a plurality of players. An electronic memory is integrated into the housing for storing a database comprising imagery and operational software for a plurality of board games. A primary touch screen is coupled to the housing to facilitate the players to play the board games. A plurality of secondary touch screens is each coupled to the housing to facilitate each of the players to control operational parameters of the board game being played. Additionally, a plurality of touch pads is each coupled to the housing thereby facilitating each of the players to input directional controls into the board game being played.

10 Claims, 3 Drawing Sheets

ELECTRONIC BOARD GAME ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to board game devices and more particularly pertains to a new board game device for digital versions of board games. The board game device includes a primary touch screen for displaying the digital version of the board games. Additionally, the board game device includes a plurality of secondary touch screens that are assigned to each of the players for controlling operational parameters of the board games.

(2) Description of Related Art Including Information Disclosed Under 37 CFR 1.97 and 1.98

The prior art relates to board game devices including a variety of electronic gaming tables that have electronic touch screens being integrated therein for playing digital board games. In no instance does the prior art disclose a portable device that can facilitate multiple players to play a digital board game.

(h) BRIEF SUMMARY OF THE INVENTION

An embodiment of the disclosure meets the needs presented above by generally comprising a housing that is positionable on a horizontal support to be accessible to a plurality of players. An electronic memory is integrated into the housing for storing a database comprising imagery and operational software for a plurality of board games. A primary touch screen is coupled to the housing to facilitate the players to play the board games. A plurality of secondary touch screens is each coupled to the housing to facilitate each of the players to control operational parameters of the board game being played. Additionally, a plurality of touch pads is each coupled to the housing thereby facilitating each of the players to input directional controls into the board game being played.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
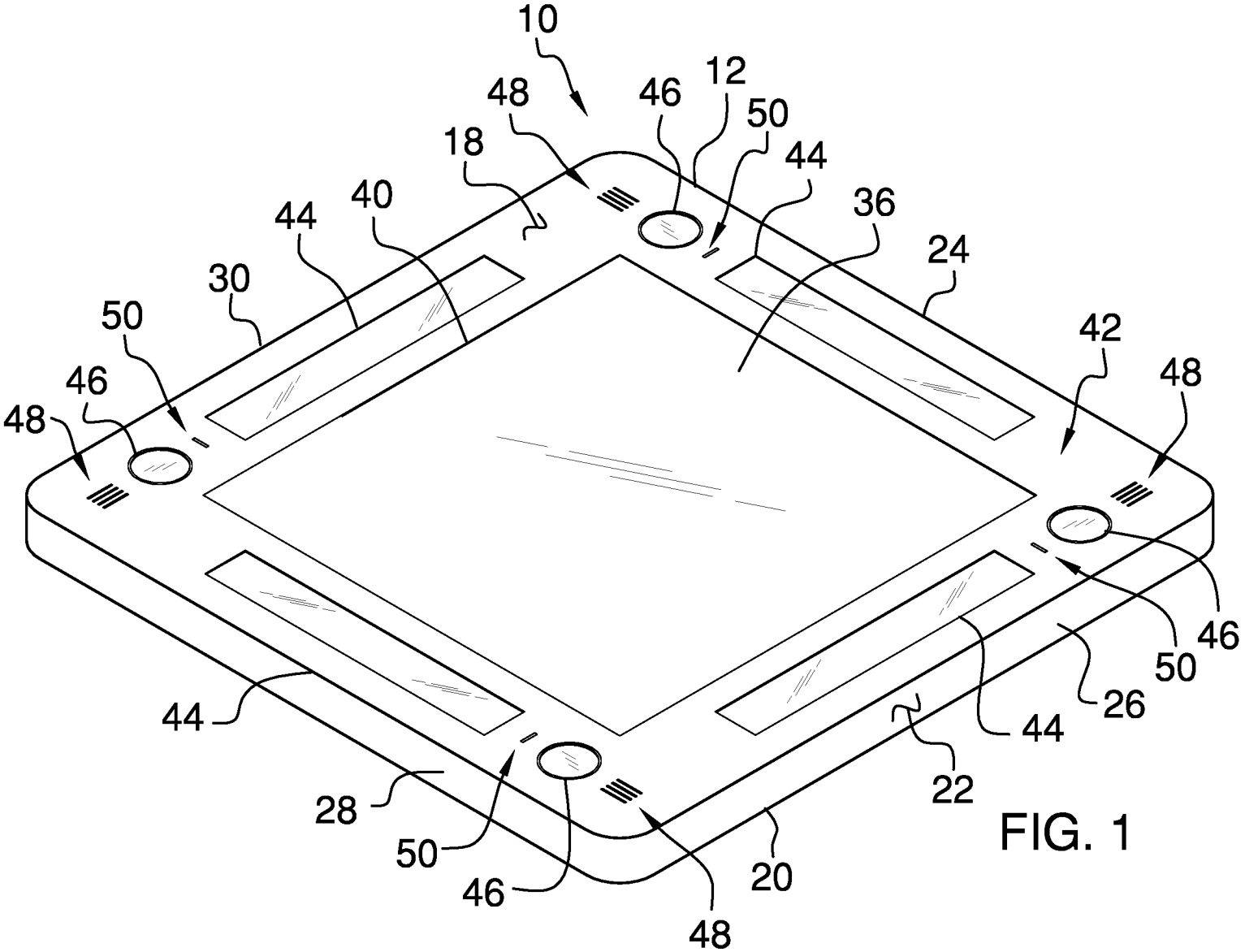
FIG. 1 is a top perspective view of an electronic board game assembly according to an embodiment of the disclosure.
Figure 2:
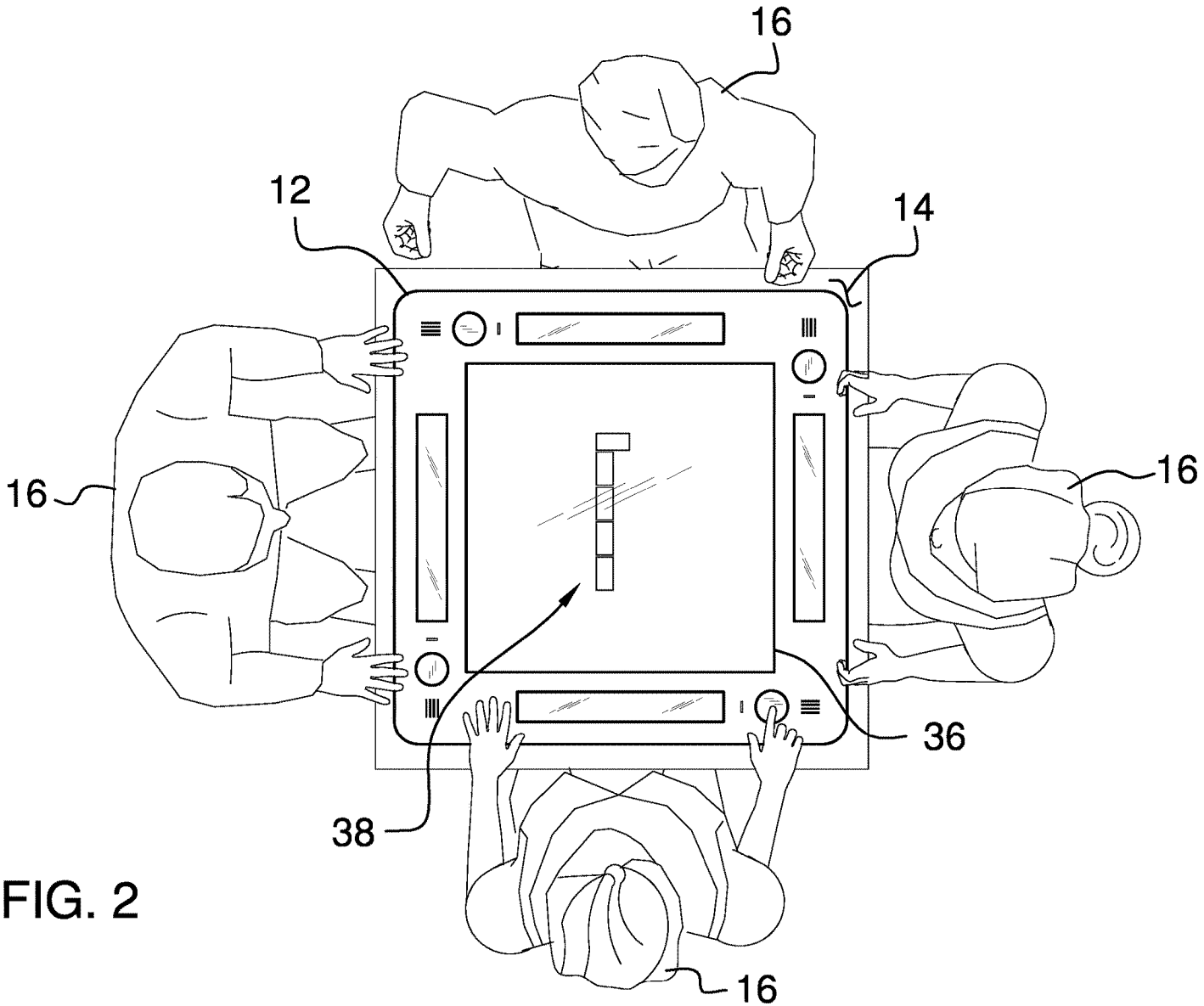
FIG. 2 is a perspective in-use view of an embodiment of the disclosure.
Figure 3:
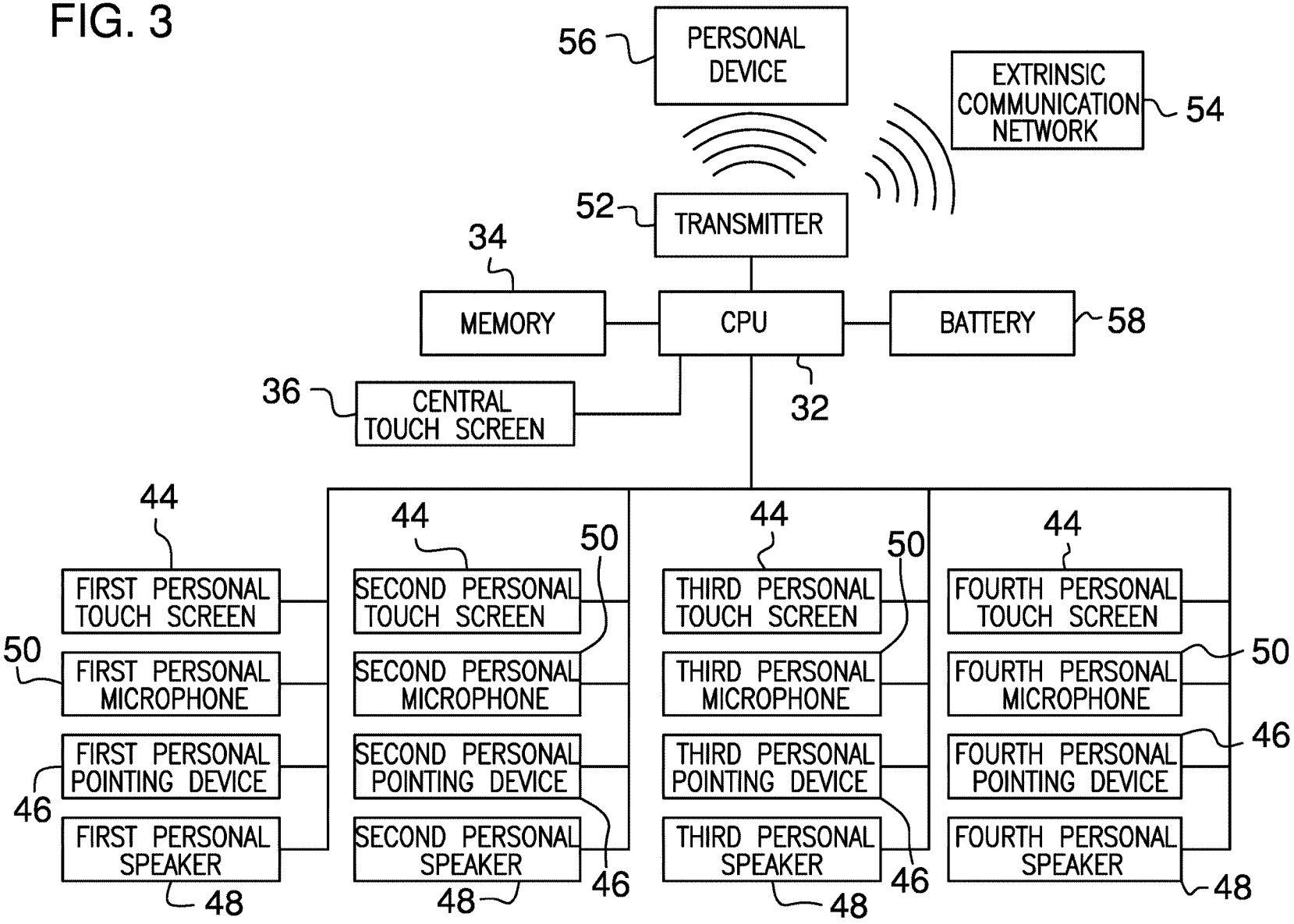
FIG. 3 is a schematic view of an embodiment of the disclosure.

With reference now to the drawings, and in particular to FIGS. 1 through 3 thereof, a new board game device embodying the principles and concepts of an embodiment of the disclosure and generally designated by the reference numeral 10 will be described.

As best illustrated in FIGS. 1 through 3, the electronic board game assembly 10 generally comprises a housing 12 that is positionable on a horizontal support surface 14, such as a table top or the like, such that the housing 12 is accessible to a plurality of players 16. The housing 12 has a top surface 18, a bottom surface 20 and a perimeter surface 22 extending therebetween, and the perimeter surface 22 has a first side 24, a second side 26, a third side 28 and a fourth side 30. Each of the first side 24, the second side 26, the third side 28 and the fourth side 30 intersect at a right angle such that the housing 12 has a rectangular shape. The housing 12 may have a length and a width ranging between approximately 24.0 inches and 30.0 inches.

A control circuit 32 is integrated into the housing 12 and an electronic memory 34 is integrated into the housing 12. The electronic memory 34 is electrically coupled to the control circuit 32 and the electronic memory 34 stores a database comprising imagery and operational software for a plurality of board games. The plurality of board games may include popular board games, including but not being limited to, checkers, chess, dominos, scrabble and backgammon. Additionally, the plurality of board games may include licensed board games, including but not being limited to, Monopoly, Risk, Sorry and Life.

A primary touch screen 36 is coupled to the housing 12 such that the primary touch screen 36 is visible and accessible to the players 16. The primary touch screen 36 is in communication with the electronic memory 34 thereby facilitating the primary touch screen 36 to display indicia 38 comprising icons and imagery associated with the board games. In this way the primary touch screen 36 facilitates the players 16 to play the board games. Moreover, the primary touch screen 36 facilitates the board games to be played without the need for physical game pieces, dice, cards and other physical objects that would typically be necessary to play the board games.

The primary touch screen 36 is positioned on the top surface 18 of the housing 12 and the primary touch screen 36 has a perimeter edge 40. The perimeter edge 40 is spaced from the perimeter surface 22 of the housing 12 to define a border 42 extending around the primary touch screen 36. Additionally, the primary touch screen 36 is electrically coupled to the control circuit 32 for receiving the icons and imagery from the electronic memory 34. The primary touch screen 36 may be an electronic touch screen, such as an LCD or the like, and the primary touch screen 36 may have a length and a width of approximately 20.0 inches. In this way the border 42 may have a width ranging between approximately 4.0 inches and 10.0 inches.

A plurality of secondary touch screens 44 is provided and each of the secondary screens is coupled to the housing 12. The plurality of secondary touch screens 44 is distributed around the housing 12 such that each of the secondary touch screens 44 is accessible to a respective player. Each of the secondary touch screens 44 is in communication with the electronic memory 34 thereby facilitating each of the secondary touch screens 44 to display control icons and imagery associated with the board game being played. In this way the plurality of secondary touch screens 44 facilitates each of the players 16 to control operational parameters of the board game being played.

Each of the secondary touch screens 44 is positioned on the top surface 18 of the housing 12 and each of secondary touch screens 44 is positioned on the border 42 defined between the primary touch screen 36 and the perimeter surface 22 of the housing 12. Each of the secondary touch screens 44 is oriented to extend substantially along a respective one of the first side 24, the second side 26, the third side 28 and the fourth side 30 of the perimeter surface 22. Additionally, each of the secondary touch screens 44 is electrically coupled to the control circuit 32 for receiving the icons and imagery from the electronic memory 34. Each of the secondary touch screens 44 may comprise an electronic touch screen, such as an LCD or the like.

A plurality of touch pads 46 is provided and each of the touch pads 46 is coupled to the housing 12. The touch pads 46 are distributed around the housing 12 such that each of the touch pads 46 is accessible to a respective player. Each of the touch pads 46 is in communication with the electronic memory 34 thereby facilitating each of the touch pads 46 to input directional controls into the board game is played, and each of the touch pads 46 is electrically coupled to the control circuit 32. Each of the touch pads 46 may comprise an electronic touch pad or the like that can detect the location of the player's finger on the touch pad. Each of the touch pads 46 is positioned on the top surface 18 of the housing 12, and each of the touch pads 46 is positioned on the border 42 defined between the primary touch screen 36 and the perimeter surface 22 of the housing 12. Each of the touch pads 46 is positioned adjacent to a respective one of the first side 24, the second side 26, the third side 28 and the fourth side 30 of the perimeter surface 22 of the housing 12.

A plurality of speakers 48 is provided and each of the speakers 48 is coupled to the housing 12 to emit audible sounds outwardly therefrom. Each of the speakers 48 is in communication with the electronic memory 34 thereby facilitating each of the speakers 48 to receive an audio signal for the board game being played. Each of the speakers 48 emits audible audio related to the board game being played and each of the speakers 48 is electrically coupled to the control circuit 32. Additionally, each of the speakers 48 may comprise an electronic speaker or the like. Each of the speakers 48 is integrated into the top surface 18 of the housing 12, and each of the speakers 48 is positioned on the border 42 defined between the primary touch screen 36 and the perimeter surface 22 of the housing 12. Each of the speakers 48 is aligned with a respective one of the first side 24, the second side 26, the third side 28 and the fourth side 30 of the perimeter surface 22 of the housing 12.

A plurality of microphones 50 is each integrated into the housing 12 to capture audible sounds. Each of the microphones 50 is in communication with the electronic memory 34 thereby facilitating each of the microphones 50 to communicate verbal commands to the board game being played. Additionally, each of the microphones 50 is electrically coupled to the control circuit 32. Each of the microphones 50 may comprise an electronic microphone or the like. Each of the microphones 50 is integrated into the top surface 18 of the housing 12, and each of the microphones 50 is positioned on the border 42 defined between the primary touch screen 36 and the perimeter surface 22 of the housing 12. Each of the microphones 50 is aligned with a respective one of the first side 24, the second side 26, the third side 28 and the fourth side 30 of the perimeter surface 22 of the housing 12.

A transceiver 52 is integrated into the housing 12 and the transceiver 52 is in communication with the electronic memory 34. Additionally, the transceiver 52 is in communication with an extrinsic communication network 54 thereby facilitating the transceiver 52 to download data from the extrinsic communication network 54 into the electronic memory 34 for updating and installing board games. The extrinsic communication network 54 may the internet or other type of wireless communication network. The transceiver 52 is in wireless communication with a personal electronic device 56 thereby facilitating the transceiver 52 to download data from the personal electronic device 56 into the electronic memory 34 for updating and installing board games. The personal electronic device 56 may comprise a smart phone or other type of device that has wireless communication capabilities. The transceiver 52 is electrically coupled to the control circuit 32. A power supply 58 is integrated into the housing 12, the power supply 58 is electrically coupled to the control circuit 32 and the power supply 58 comprises at least one battery.

In use, the housing 12 is placed on the support surface 14 to facilitate the players 16 to play board games on the primary touch screen 36. Each player can employ a respective secondary touch screen 44 to control operational parameters of the board game, to access the data stored in the electronic memory 34, and control all aspects of game play. Additionally, each player can employ a respective touch pad 46 to input direction control into a cursor or other graphic user interface that is displayed on the primary touch screen 36. In this way the players 16 can play a variety of different board games without the need for game pieces, dice, cards or game boards. The electronic memory 34 can be updated with data downloaded from the personal electronic device 56 or via the internet.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An electronic board game assembly for facilitating a plurality of players to play a plurality of different board games on an electronic display, said assembly comprising:

a housing being positionable on a horizontal support surface wherein said housing is configured to be accessible to a plurality of players;

an electronic memory being integrated into said housing, said electronic memory storing a database comprising imagery and operational software for a plurality of board games;

a primary touch screen being coupled to said housing wherein said primary touch screen is configured to be visible and accessible to the players, said primary touch screen being in communication with said electronic memory thereby facilitating said primary touch screen to display indicia comprising icons and imagery associated with the board games wherein said primary touch screen is configured to facilitate the players to play the board games;

a plurality of secondary touch screens, each of said secondary screens being coupled to said housing, said plurality of secondary touch screens being distributed around said housing wherein each of said secondary touch screens is configured to be accessible to a respective player, each of said secondary touch screens being in communication with said electronic memory thereby facilitating each of said secondary touch screens to display control icons and imagery associated with the board game being played wherein said plurality of secondary touch screens is configured to facilitate each of the players to control operational parameters of the board game being played;

a plurality of touch pads, each of said touch pads being coupled to said housing, said touch pads being distributed around said housing wherein each of said touch pads is configured to be accessible to a respective player, each of said touch pads being in communication with said electronic memory thereby facilitating each of said touch pads to input directional controls into the board game being played;

a plurality of speakers, each of said speakers being coupled to said housing wherein each of said speakers is configured to emit audible sounds outwardly therefrom, each of said speakers being in communication with said electronic memory thereby facilitating each of said speakers to receive an audio signal for the board game being played wherein each of said speakers is configured to emit audible audio related to the board game being played; and a plurality of microphones, each of said microphones being integrated into said housing wherein each of said microphones is configured to capture audible sounds, each of said microphones being in communication with said electronic memory thereby facilitating each of said microphones to communication verbal commands to the board game being played.

2. The assembly according to claim 1, wherein said housing has a top surface, a bottom surface and a perimeter surface extending therebetween, said perimeter surface having a first side, a second side, a third side and a fourth side, each of said first side, said second side, said third side and said fourth side intersecting an a right angle such that said housing has a rectangular shape.

3. The assembly according to claim 2, wherein said primary touch screen is positioned on said top surface of said housing, said primary touch screen having a perimeter edge, said perimeter edge being spaced from said perimeter surface of said housing to define a border extending around said primary touch screen.

4. The assembly according to claim 3, wherein each of said secondary touch screens is positioned on said top surface of said housing, each of secondary touch screens being positioned on said border defined between said primary touch screen and said perimeter surface of said housing, each of said secondary touch screens being oriented to extend substantially along a respective one of said first side, said second side, said third side and said fourth side of said perimeter surface.

5. The assembly according to claim 3, wherein each of said touch pads is positioned on said top surface of said housing, each of said touch pads being positioned on said border defined between said primary touch screen and said perimeter surface of said housing, each of said touch pads being positioned adjacent to a respective one of said first side, said second side, said third side and said fourth side of said perimeter surface of said housing.

6. The assembly according to claim 3, wherein each of said speakers is integrated into said top surface of said housing, each of said speakers being positioned on said border defined between said primary touch screen and said perimeter surface of said housing, each of said speakers being aligned with a respective one of said first side, said second side, said third side and said fourth side of said perimeter surface of said housing.

7. The assembly according to claim 3, wherein each of said microphones is integrated into said top surface of said housing, each of said microphones being positioned on said border defined between said primary touch screen and said perimeter surface of said housing, each of said microphones being aligned with a respective one of said first side, said second side, said third side and said fourth side of said perimeter surface of said housing.

8. The assembly according to claim 3, further comprising a transceiver being integrated into said housing, said transceiver being in communication with said electronic memory, said transceiver being in communication with an extrinsic communication network thereby facilitating said transceiver to download data from the extrinsic communication network into said electronic memory for updating and installing board games, said transceiver being in wireless communication with a personal electronic device thereby facilitating said transceiver to download data from the personal electronic device into said electronic memory for updating and installing board games, said transceiver being electrically coupled to said control circuit.

9. The assembly according to claim 1, wherein:

said assembly includes a control circuit being integrated into said housing;

said electronic memory is electrically coupled to said control circuit;

said primary touch screen is electrically coupled to said control circuit for receiving said icons and imagery from said electronic memory;

each of said secondary touch screens is electrically coupled to said control circuit for receiving said icons and imagery from said electronic memory;

each of said touch pads is electrically coupled to said control circuit;

each of said speakers being electrically coupled to said control circuit; and each of said microphones is electrically coupled to said control circuit.

10. An electronic board game assembly for facilitating a plurality of players to play a plurality of different board games on an electronic display, said assembly comprising:

a housing being positionable on a horizontal support surface wherein said housing is configured to be accessible to a plurality of players, said housing having a top surface, a bottom surface and a perimeter surface extending therebetween, said perimeter surface having a first side, a second side, a third side and a fourth side, each of said first side, said second side, said third side and said fourth side intersecting an a right angle such that said housing has a rectangular shape;

a control circuit being integrated into said housing;

an electronic memory being integrated into said housing, said electronic memory being electrically coupled to said control circuit, said electronic memory storing a database comprising imagery and operational software for a plurality of board games;

a primary touch screen being coupled to said housing wherein said primary touch screen is configured to be visible and accessible to the players, said primary touch screen being in communication with said electronic memory thereby facilitating said primary touch screen to display indicia comprising icons and imagery associated with the board games wherein said primary touch screen is configured to facilitate the players to play the board games, said primary touch screen being positioned on said top surface of said housing, said primary touch screen having a perimeter edge, said perimeter edge being spaced from said perimeter surface of said housing to define a border extending around said primary touch screen, said primary touch screen being electrically coupled to said control circuit for receiving said icons and imagery from said electronic memory;

a plurality of secondary touch screens, each of said secondary screens being coupled to said housing, said plurality of secondary touch screens being distributed around said housing wherein each of said secondary touch screens is configured to be accessible to a respective player, each of said secondary touch screens being in communication with said electronic memory thereby facilitating each of said secondary touch screens to display control icons and imagery associated with the board game being played wherein said plurality of secondary touch screens is configured to facilitate each of the players to control operational parameters of the board game being played, each of said secondary touch screens being positioned on said top surface of said housing, each of secondary touch screens being positioned on said border defined between said primary touch screen and said perimeter surface of said housing, each of said secondary touch screens being oriented to extend substantially along a respective one of said first side, said second side, said third side and said fourth side of said perimeter surface, each of said secondary touch screens being electrically coupled to said control circuit for receiving said icons and imagery from said electronic memory;

a plurality of touch pads, each of said touch pads being coupled to said housing, said touch pads being distributed around said housing wherein each of said touch pads is configured to be accessible to a respective player, each of said touch pads being in communication with said electronic memory thereby facilitating each of said touch pads to input directional controls into the board game being played, each of said touch pads being electrically coupled to said control circuit, each of said touch pads being positioned on said top surface of said housing, each of said touch pads being positioned on said border defined between said primary touch screen and said perimeter surface of said housing, each of said touch pads being positioned adjacent to a respective one of said first side, said second side, said third side and said fourth side of said perimeter surface of said housing;

a plurality of speakers, each of said speakers being coupled to said housing wherein each of said speakers is configured to emit audible sounds outwardly therefrom, each of said speakers being in communication with said electronic memory thereby facilitating each of said speakers to receive an audio signal for the board game being played wherein each of said speakers is configured to emit audible audio related to the board game being played, each of said speakers being electrically coupled to said control circuit, each of said speakers being integrated into said top surface of said housing, each of said speakers being positioned on said border defined between said primary touch screen and said perimeter surface of said housing, each of said speakers being aligned with a respective one of said first side, said second side, said third side and said fourth side of said perimeter surface of said housing;

a plurality of microphones, each of said microphones being integrated into said housing wherein each of said microphones is configured to capture audible sounds, each of said microphones being in communication with said electronic memory thereby facilitating each of said microphones to communication verbal commands to the board game being played, each of said microphones being electrically coupled to said control circuit, each of said microphones being integrated into said top surface of said housing, each of said microphones being positioned on said border defined between said primary touch screen and said perimeter surface of said housing, each of said microphones being aligned with a respective one of said first side, said second side, said third side and said fourth side of said perimeter surface of said housing;

a transceiver being integrated into said housing, said transceiver being in communication with said electronic memory, said transceiver being in communication with an extrinsic communication network thereby facilitating said transceiver to download data from the extrinsic communication network into said electronic memory for updating and installing board games, said transceiver being in wireless communication with a personal electronic device thereby facilitating said transceiver to download data from the personal electronic device into said electronic memory for updating and installing board games, said transceiver being electrically coupled to said control circuit; and a power supply being integrated into said housing, said power supply being electrically coupled to said control circuit, said power supply comprising at least one battery.

* * * * *